US006325230B1

(12) United States Patent
Muenster et al.

(10) Patent No.: US 6,325,230 B1
(45) Date of Patent: Dec. 4, 2001

(54) GALVANIZING TANK

(75) Inventors: Torsten Muenster, Villingen-Schwenningen; Emil Hepting, Bad Duerrheim, both of (DE)

(73) Assignee: Korrotech GmbH u. Co. KG (DE)

( * ) Notice: Subject to any disclaimer, the term of this patent is extended or adjusted under 35 U.S.C. 154(b) by 0 days.

(21) Appl. No.: 09/635,084

(22) Filed: Aug. 8, 2000

(51) Int. Cl.[7] ..... B65D 21/02
(52) U.S. Cl. ..... 220/23.87
(58) Field of Search ..... 220/565, 23.91, 220/23.87, 720, 721, 678; 118/429, 400

(56) References Cited

U.S. PATENT DOCUMENTS

| | | | | |
|---|---|---|---|---|
| 1,721,311 | * | 7/1929 | Muenchen . | |
| 1,920,486 | | 8/1933 | Smith . | |
| 2,269,994 | * | 1/1942 | Sperry . | |
| 2,294,393 | * | 9/1942 | Erne | 220/23.87 |
| 2,339,876 | * | 1/1994 | Phillips | 220/721 |
| 2,541,090 | * | 2/1951 | Orr et al. | 220/721 |
| 3,599,601 | * | 8/1971 | Ishikawa et al. | 118/50 |
| 3,654,956 | * | 4/1972 | Tsubouchi | 340/450.1 |
| 3,833,163 | * | 9/1974 | Denslow et al. | 228/56.2 |
| 4,603,656 | * | 8/1986 | Jaye Jr. | 118/429 |
| 5,720,815 | * | 2/1998 | Swain | 118/407 |
| 5,782,374 | * | 7/1998 | Walker | 119/61 |

FOREIGN PATENT DOCUMENTS

| | | | |
|---|---|---|---|
| 145 641 | 12/1980 | (DE) | C23G/3/00 |
| 681 01 275 U2 | 7/1981 | (DE) | C25D/17/02 |
| 213 698 | 9/1984 | (DE) | C23G/3/00 |
| 234 448 A1 | 4/1986 | (DE) | C25D/17/02 |
| 263 795 A1 | 1/1989 | (DE) | C25D/17/02 |

* cited by examiner

*Primary Examiner*—Stephen Castellano
(74) *Attorney, Agent, or Firm*—Pendorf & Cutliff

(57) ABSTRACT

In order to make possible the tension-free expansion during temperature changes in a galvanizing tank made of a steel outer tub (1) with a plastic inner tub (5) seated therein, and besides this to achieve a water-tight and gas-tight seal between the inner (5) and the outer tub (1), there is provided on the upper rim of the inner tub (5) a circumscribing water-lock (8) forming channel (15), into which the inner shank (12) of a preferably U-shaped frame (10) resting upon the rim (3) of the outer tub (1) extends. The channel (15) is filled with a fluid (9), preferably water, into which the shank (12) dips without however resting upon the floor of the channel (15). The upper rim of the channel (15) is lower than the rim of the inner tub (5) so that water (9) overflowing out of the water lock (8) does not flow into the interstitial space (6) between the inner (5) and the outer tub (1), but rather flows into the inner tub (5).

11 Claims, 3 Drawing Sheets

GALVANIZING TANK

BACKGROUND OF THE INVENTION

1. Field of the Invention

The invention concerns a galvanizing tank with an outer tub of steel, within which an inner tub of chemically resistant plastic is seated.

For chemical or electrochemical surface treatment of parts, the parts with their surfaces to be treated are dipped into baths comprising aggressive media, for example acids or lye.

Because of the static loads, it is preferred that the bath be provided in a tub of a sturdy material, for example of steel or concrete. However, materials with a sufficiently high sturdiness have the disadvantage that they are attacked by the aggressive media and are destroyed, while materials resistant to aggressive media do not exhibit sufficient stability. In order to combine the static load bearing characteristics with a reliable protection against aggressive media, two solutions are known.

The first approach to solving the problem envisions that the tub of the static load bearing material, for example a steel tub, is cladded with a chemically resistant plastic, while in the second approach an inner tub of a chemically resistant plastic is seated in this steel tub. The present invention is concerned with this second approach.

The aggressive media is located in an inner tub, frequently referred to as inner liner, of chemically resistant material, for example of plastic, which is seated in an outer tub made for example of steel or concrete. Depending on the type of the surface treatment, media in the inner tub is heated to a temperature of 100° C. An arrangement comprised of an outer tub and an inner tub seated in the outer tub for receiving an aggressive media is thus subject to multifaceted requirements and strong stresses. The inner tub must on the one hand be resistant against the aggressive media. Because of the different thermal coefficients of expansion of the inner and the outer tub, which are made of the different materials—plastic for the inner tub, steel for the outer tub—there must on the other hand be provided suitable precautionary means, in order to prevent mechanical damage, for example tears, of the two tubs as well as a leakage or overflow of the aggressive media.

2. Description of the Related Art

From DD 213 698 B1 an arrangement of this type, with an outer tub and an inner tub, is known.

In the outer tub with a rim made of steel is seated an inner tub of polypropylene with narrower breadth and width than the internal breadth and length of the outer tub, in order to provide sufficient space for lengthwise and widthwise expansion of the inner wall caused by rising temperature. On the upper edge of the inner tub a trapezoid-shaped circumscribing shank is welded on, which lies on the rim of the outer tub. The inner kink-bend of the shank is directed upwardly and curved outwards, so that the inner wall can expand upwardly, the shank however nevertheless remains resting upon the rim of the outer wall.

A first disadvantage of this known arrangement lies therein, that the trapezoid-shaped shank lying on the rim of the outer tub has no flat or planar resting surface, but rather exhibits an arc directed upwardly. A second disadvantage is to be seen therein, that this arc changes with temperature changes.

In DD 145 641 a further arrangement of an outer tub and an inner tub is known.

The inner wall of plastic exhibits raised weld beads, on which the inner tub rests upon the outer tub, in order to provide space for the expansion of the inner wall as a result of increases in temperature.

In this arrangement there is the danger, that fluids running out of the inner wall can flow into the space between the inner and outer tub.

Finally, from DD 234 448 A1 a further arrangement of an outer and an inner tub is described.

One plastic tub seated in a steel tub lies only in the upper rim area and only partially on the floor on the steel tub, so that the plastic tub can expand in a pillow-like manner as a consequence of increases in temperatures.

Also in this arrangement there is the danger that overflowing fluids out of the inner tub flow into the space between the inner and outer tub.

SUMMARY OF THE INVENTION

It is thus the task of the invention to design a galvanizing tank with an outer tub and an inner tub, such that for its part a tension-free expansion of the inner tub is ensured and on the other hand a spilling out or overflowing of the aggressive media provided in the inner tub into the space between the inner and the outer tub is prevented.

This task is solved according to claim 1, in that in the upper rim area of the inner side of the inner tub a circumscribing channel is provided for receiving of fluids, and that a frame with at least one shank lies upon the tub rim of the outer tub, which extends or dips into the channel, without however lying upon the floor thereof.

Since the channel is filled with fluid, for example water, it forms a water lock in cooperation with the shank of the frame which dips into the fluid, which water lock seals off the inner tub fluid-tight and gas-tight against the outer tub, and makes possible at the same time a tension-free expansion of the inner tub upwardly.

BRIEF DESCRIPTION OF THE DRAWINGS

On the basis of the illustrative embodiment shown in the figures, the invention will be described and discussed.

In the drawings there is shown.

DETAILED DESCRIPTION OF THE INVENTION

Figure 1:
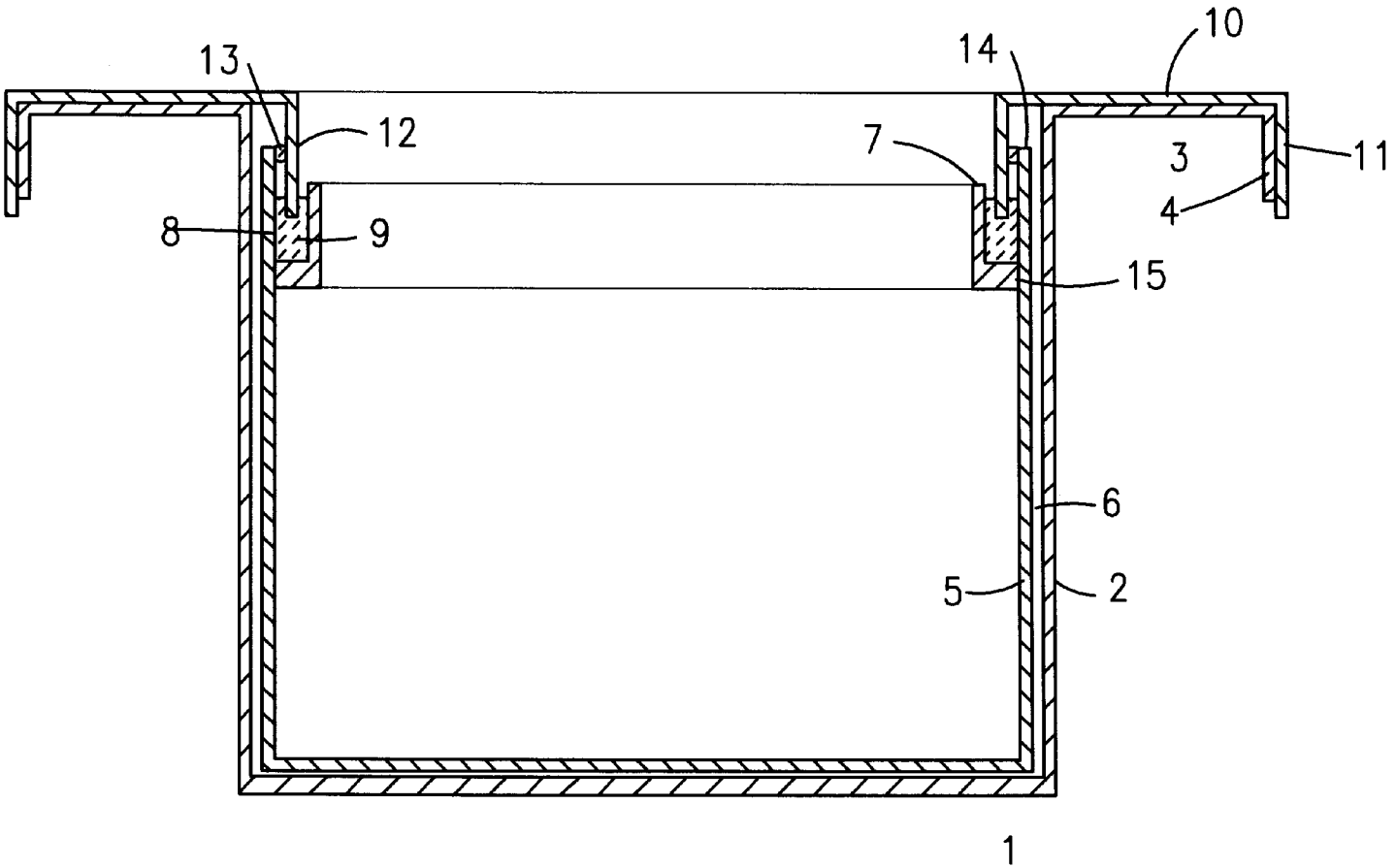
FIGS. 1 and 3 A longitudinal section through a first illustrative embodiment of the invention and FIGS. 2 and 4 an enlarged section of the upper rim area of FIG. 1.
Figure 4:
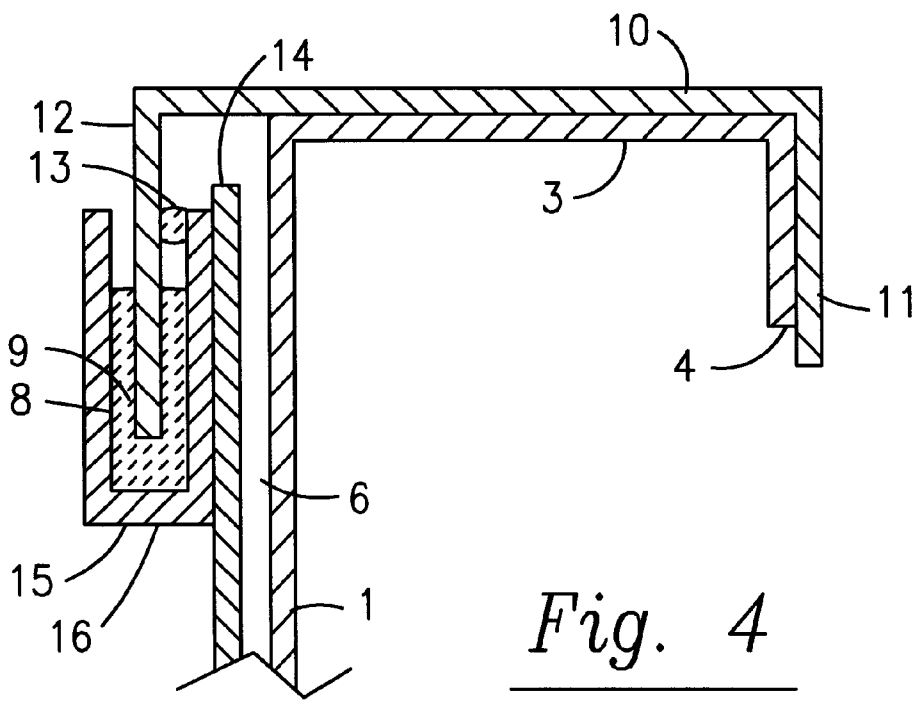

In FIG. 1 there is provided a frame running round and extending out perpendicular to the side wall 2 of an outer tub 1 formed for example of steel, of which the end 4 is bent at right angle downward. The inner tub 5 is seated in the outer tub 1 in such a manner that between the inner tub 5 and the outer tub 1 an interstitial space 6 for the longitudinal expansion of the inner tub 6 remains. In the upper area a circumscribing channel 15 is provided on the inner side of the inner tub 6, of which the upper edge 7 is lower than the upper edge 14 of the inner tub 5. The channel 15 is filled with a fluid 9, for example water.

On the rim 3 of the outer wall 1 there lies a frame 10 with a U-shaped cross section and two shanks 11 and 12. The outer shank 11 lies flush on the right-angle bent end 4 of the frame 3 of the outer tub 1, while the inner shank 12 dips into the channel 15, without however lying upon the floor thereof. The one wall of the channel 15 is formed by the walls of the inner tub 14. The other wall and the floor of the channel 15 are formed as an L-shaped part 7, which is secured to the inner side of the inner tub. Preferably the L-shaped part 7 is welded to the inner side of the inner wall 5. The channel 15 is filled with a fluid, for example with water.

As already discussed, the channel 15 and the shank 12 of the frame 10 form a water lock 8, which makes possible on the one hand the sealing off of the interstitial space between the inner tub 5 and the outer tub 1 against the fluids and vapors and on the other hand makes possible a tension-free upwards expansion of the inner tub 5.

In order to prevent the climbing up of fluids between the shank 12 which protrudes into the fluid 9 and the inner tub 5 as a result of capillary action, a weld bead 13 is provided between the upper rim of the inner wall 5 and the shank 12. However the frame 10 is not welded to the inner tub 5, so that the two parts are moveable relative to each other.

The inner tub 5, the circumscribing frame 10 as well as the water-lock forming channel 15 can be made for example of polyvinylfluoride.

The inner tub 5 can be manufactured for example of multiple pieces, which are welded to each other.

Figure 2:
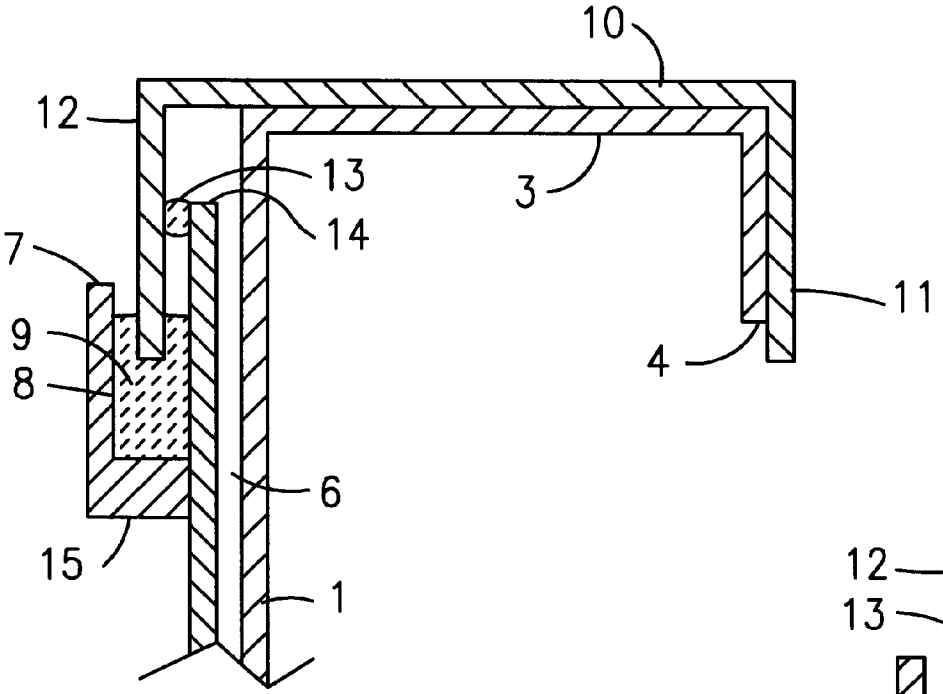
Figure 3:
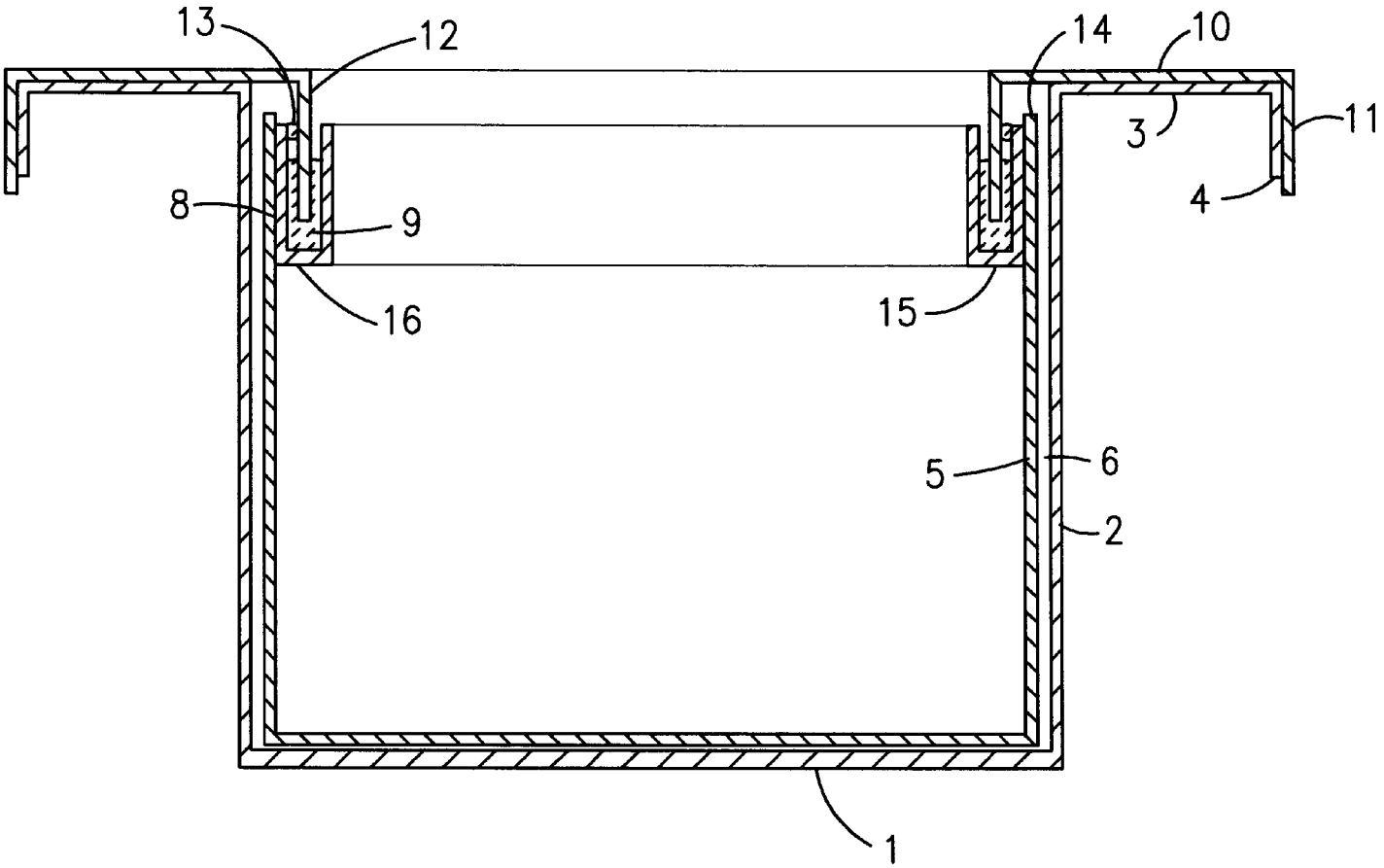

FIG. 2 is an enlarged representation of the upper rim area of the arrangement of FIG. 1 with frame 10, of which the shanks 11 and 12, the rim 3 of the right angle bent end 4 of the outer tub 1, the channel 15 filled with a fluid as well as the weld bead 13 are shown enlarged.

Upon increasing the temperature, both the inner tub 5 as well as the outer tub 1 expand in their length, breadth, and height, the plastic inner tub however more strongly due to the larger co-efficient of expansion than the outer tub 1 made of steel. The side walls of the inner tub 5 are thus moved against the side walls of the outer tub 1, however because of the interstitial space 6 provided between the inner tub 5 and the outer tub 1, it does not press against the outer tub 1. The inner tub is free to expand upwards. The further the inner tub 5 expands upwards, so much the deeper does the shank 12 of the frame 10 dip into the fluid 9 in the channel 15. The channel 15 and the shank 12 are so dimensioned that the shank 12, independent of the height expansion of the inner tub 5, remains submerged in the fluid 9, however does not come to rest upon the floor of the channel 15.

Since the channel 15 is lower than the upper edge 14 of the inner tub 5, in the case of the overflow of the channel no fluids 9 can flow between the inner tub 5 and the outer tub 1. The overflowing fluids flow in the inner tub 5.

The cross section of the channel 15 can be varied, for example arc-shaped, trapezoid-shaped or V-shaped. In place of the L-shaped part 7 there can for example a channel with U-shaped cross section be welded to the inner side of the inner tub 5.

The inventive galvanizing tank is characterized by a first advantage: that despite tension-free upwards expansion of the inner tub, the interstitial space between the inner and the outer tubs remain sealed water-tight and air-tight. The inventive galvanizing tank is further characterized by a second advantage: that its upper rim, despite the expansion of the inner tub, remains fixed in position and shape. It is thus possible to secure circuits or other devices on the rim.

Reference Number List

1 Outer tub
2 Side wall of the outer tub
3 Rim of the outer tub
4 End of rim 3
5 Inner tub
6 Interstitial space
7 L-shaped part
8 Water lock
9 Fluid
10 Frame
11 Shank
12 Shank
13 Weld bead
14 Upper Rim
15 Channel

What is claimed is:

1. A galvanizing tank comprising:

an outer tub of steel;

an inner tub of a chemically resistant plastic, the inner tub seated in the outer tub, the inner tub having an inner side and an outer side;

an interstitial space between the inner tub and the outer tub for the longitudinal expansion of the inner tub;

a circumscribing channel in the upper rim area of the inner side of the inner tub for receiving a fluid; and a frame seated on the rim of the outer tub, the frame having an outer shank and an inner shank, the inner shank extends into the channel without resting on the floor thereof.

2. A galvanizing tank according to claim 1, wherein the frame (10) exhibits a U-shaped cross section with outer and inner shanks (11, 12).

3. A galvanizing tank according to claim 1, wherein the channel (15) exhibits a U-shaped cross section.

4. A galvanizing tank according to claim 3, wherein the one wall of the channel (15) is formed by the walls of the inner tub (5) and that the other wall and the floor of the channel (15) are designed as L-shaped part (7).

5. A galvanizing tank according to claim 4, wherein the L-shaped part (7) is welded to the inner side of the inner wall (5).

6. A galvanizing tank according to claim 1, wherein the frame (10) is so designed, that it completely covers over the entire tub rim (3) of the outer tub (1).

7. A galvanizing tank according to claim 6, wherein the outer shank (11) of the frame (10) lies flush against a right angle bent end (4) of the rim (3) of the outer tub (1).

8. A galvanizing tank according to claim 1, wherein the upper rim (14) of the inner tub (5) is higher than the channel (15).

9. A galvanizing tank according to claim 8, wherein the upper rim (14) of the inner tub (5) is provided with a circumscribing ridge, in particular a weld bead (13), for minimizing the separation between the frame (10) and the inner tub (5) while preventing capillary action.

10. A galvanizing tank according to claim 1, wherein the inner wall (5) of the channel (15) and the frame (10) are made of polyvinylfluoride.

11. A galvanizing tank comprising:

an outer tub of steel;

an inner tub of a chemically resistant plastic, the inner tub seated in the outer tub, the inner tub having an inner side and an outer side;

an interstitial space between the inner tub and the outer tub for the longitudinal expansion of the inner tub;

a circumscribing channel in the upper rim area of the inner side of the inner tub for receiving a fluid; and a frame seated on the rim of the outer tub, the frame having an outer shank and an inner shank, the inner shank extends into the channel without resting on the floor thereof wherein the channel (15) is formed as a U-shaped part, which is welded to the inner side of the inner tub (5).

* * * * *